United States Patent [19]

Trotta et al.

[11] Patent Number: 5,072,999

[45] Date of Patent: Dec. 17, 1991

[54] VOTING BOOTH

[75] Inventors: Frank Trotta, Maplewood, N.J.; Gary Gray, Thompson, Pa.

[73] Assignee: Electronic Voting Systems, Inc., New York, N.Y.

[21] Appl. No.: 427,612

[22] Filed: Oct. 27, 1989

[51] Int. Cl.[5] ..... G07C 13/00

[52] U.S. Cl. ..... 312/249; 312/258; 235/51; 52/36

[58] Field of Search ..... 52/36, 239, 249, 250; 312/3, 4, 5, 233, 244, 250, 258, 265.1, 265.4, 266, 309, 322; 235/51

[56] References Cited

U.S. PATENT DOCUMENTS

| | | | |
|---|---|---|---|
| Re. 28,613 | 11/1975 | Bolt | 312/258 X |
| D. 282,375 | 1/1986 | Dolson . | |
| 1,227,704 | 5/1917 | Ulrich | 312/250 |
| 1,329,731 | 2/1920 | Veasey | 52/239 X |
| 1,374,868 | 4/1921 | White | 312/265.2 |
| 1,408,731 | 3/1922 | Harris | 312/3 X |
| 1,668,566 | 5/1928 | Link | 312/223 |
| 2,113,995 | 4/1938 | Salvage | 312/250 |
| 2,742,675 | 4/1956 | Robertson | 312/250 |
| 3,286,918 | 11/1966 | Coyle . | |
| 3,322,478 | 5/1967 | Brown . | |
| 3,333,766 | 8/1967 | Crossland et al. . | |
| 3,389,947 | 6/1968 | Kelley et al. . | |
| 3,531,170 | 9/1970 | Boyer . | |
| 3,620,587 | 11/1971 | Ahmann . | |
| 3,652,012 | 3/1972 | Harris et al. . | |
| 3,806,219 | 4/1974 | Ahmann . | |
| 4,073,556 | 2/1978 | Wilson | 312/250 |
| 4,288,134 | 9/1981 | Knaack | 312/244 X |
| 4,354,652 | 1/1983 | Ahmann . | |
| 4,377,367 | 3/1983 | Smith . | |
| 4,417,774 | 11/1983 | Bevan | 312/258 |
| 4,445,731 | 5/1984 | Ahmann . | |
| 4,451,728 | 5/1984 | McKay et al. . | |
| 4,484,787 | 11/1984 | Stephens . | |
| 4,510,378 | 4/1985 | Dolson . | |
| 4,569,564 | 2/1986 | Ahmann . | |
| 4,660,904 | 4/1987 | Stephens . | |
| 4,712,757 | 12/1987 | Ahmann . | |
| 4,733,507 | 3/1988 | Doublet . | |

FOREIGN PATENT DOCUMENTS

| | | |
|---|---|---|
| 2902803 | 7/1980 | Fed. Rep. of Germany . |
| 2613514 | 10/1988 | France . |
| 2196663 | 5/1988 | United Kingdom . |
| 2212182 | 7/1989 | United Kingdom . |

OTHER PUBLICATIONS

United Kingdom printed application 2 206 279, Jan. 5, 1989, 3 drawings; 8 spec.

*Primary Examiner*—John E. Murtagh

*Attorney, Agent, or Firm*—Hedman, Gibson, Costigan & Hoare

[57] ABSTRACT

A movable heavy duty voting booth with a structural frame and lightweight panels to accommodate electronic voting mechanisms.

16 Claims, 5 Drawing Sheets

VOTING BOOTH

FIELD OF THE INVENTION

This invention relates to movable voting booths. More particularly, the invention relates to an easily movable, durable, heavy duty voting booth structure for accommodating electronic voting mechanisms.

BACKGROUND OF THE INVENTION

Traditionally, voting booths have been structured to afford privacy to the individual voter. Even when ballots were cast by an individual marking the selections in writing and depositing the paper ballot in a sealed box or other depository, means were provided to conceal the voter from people in the voting area.

The advent of the mechanical voting machine provided a single complex structure by which voters automatically concealed themselves by engaging a lever that both set the voting mechanism for vote selection and surrounded the voter with a curtain. The mechanical voting machine required a relatively large and heavy structure to satisfy the capacity demanded for the typical election poll.

To this day, the voting for government officials occurs, at most, only a few times each year. Thus, voting booths must be movable and capable of being stored. Logically, storage of voting booths should be at the facility at which the voting takes place; i.e. a local civic building such as a school, town hall, post office etc. Naturally, it is desirable that storage requirements be kept to a minimum because the typical voting location usually requires the use of all available space for the principal daily activities for which the building is intended.

Recent efforts have been made to develop lightweight portable voting booth structures that can be stored off-site. Collapsible cardboard voting booth structures have been proposed as seen in U.S. Pat. Nos. 4,569,564, 4,445,731 and 3,531,170. Another approach has been the multi-purpose voting booth wherein the structure can be converted to a lecturn, dressing room or other function when it is not required for voting. U.S. Pat. Nos. 4,484,787, 4,733,507 and 4,660,904 are illustrative of this approach.

Recently electronic devices have been developed to provide a reliable and confidential means for accepting and tabulating votes. By the use of microprocessor or microcomputer implemented electronics, an actual voting mechanism with the capacity for a typical election poll can be provided that is relatively small and lightweight; i.e. less than twenty pounds.

BRIEF DESCRIPTION OF THE INVENTION

It is an object of the present invention to provide a heavy duty, lightweight voting booth structure to accommodate an electronic voting mechanism.

It is another object of the present invention to provide an easily movable voting booth that can be stored either on-site or off-site.

The voting booth structure of this invention is comprised of a heavy duty frame formed of interconnected metal members, lightweight panels attached to the frame, mounting means to support the electronic voting equipment and a wheel and caster assembly for transporting the booth between the storage location and the voting poll location.

BRIEF DESCRIPTION OF THE DRAWINGS

The subject invention will be better understood when viewed with the drawings wherein.

DESCRIPTION OF THE PREFERRED EMBODIMENTS

Figure 1:
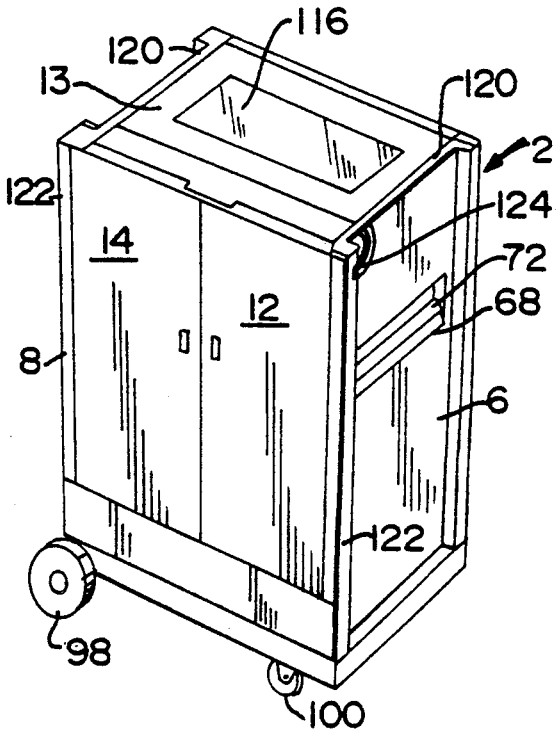
FIG. 1 is an isometric view of the voting booth of the present invention in the closed storage mode.
Figure 2:
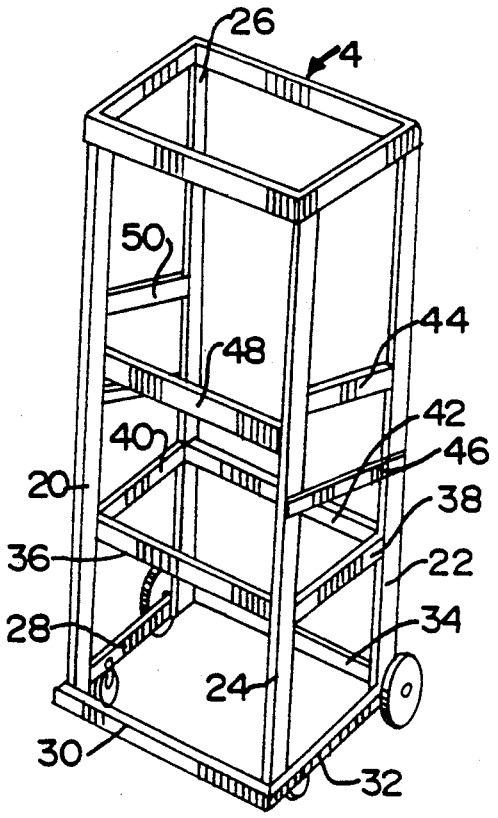
FIG. 2 is a view of the frame structure of the voting booth of the present invention.
Figure 3:
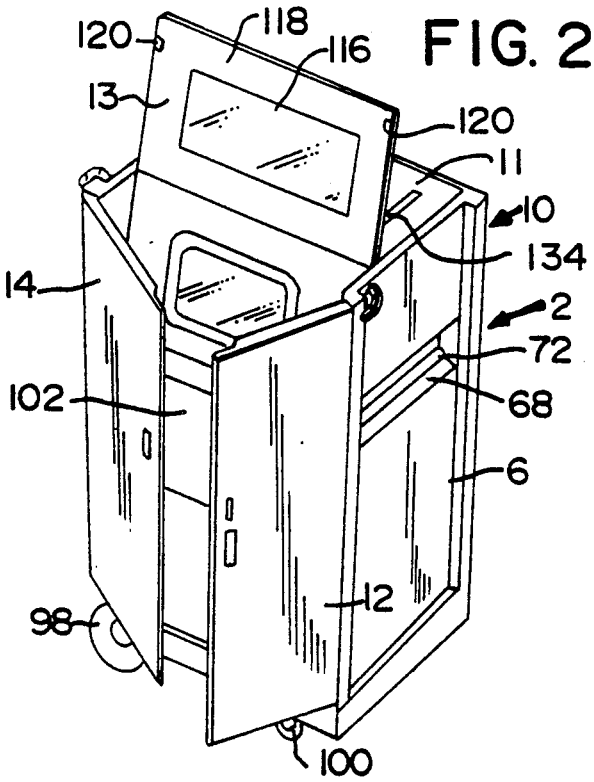
FIG. 3 is the same isometric view of the present invention depicted in FIG. 1 showing the voting booth in a partially open mode.
Figure 7:
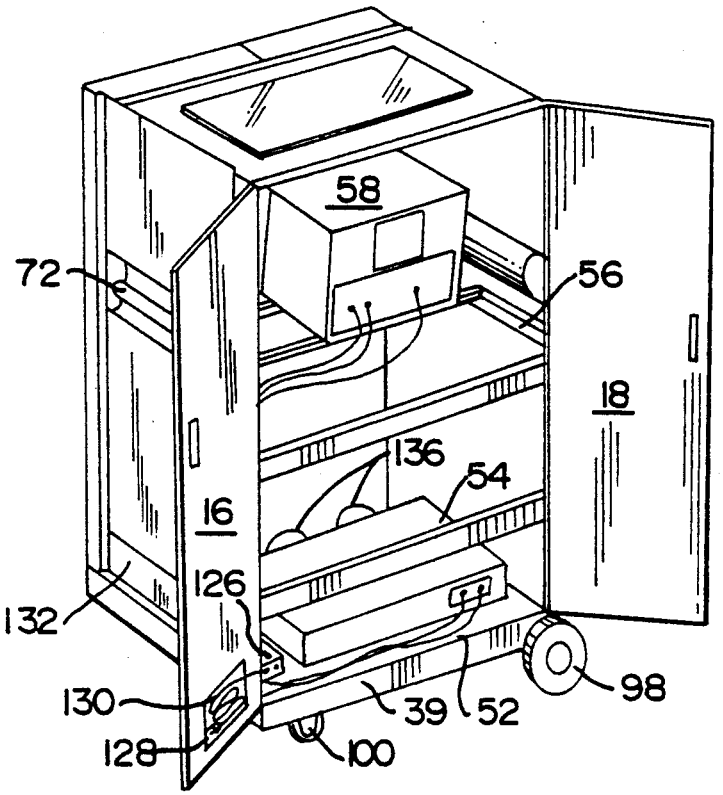
FIG. 7 is a rear view isometric of the voting booth open to reveal the rear of the electronics mounted on the heavy duty frame of the present invention.

The voting booth 2 of the present invention as seen in FIGS. 1, 2 and 7 collectively is comprised of a frame 4, side panels 6 and 8, a top 10, front doors 12 and 14 and rear doors 16 and 18.

The frame 4, in the preferred embodiment seen in FIG. 2, is comprised of four vertical corner channel members 20, 22, 24 and 26, base connecting horizontal channel members 28, 30, 32 and 34 and intermediate horizontal channel members 36, 38, 40, 42, 44, 46, 48 and 50.

Figure 6:
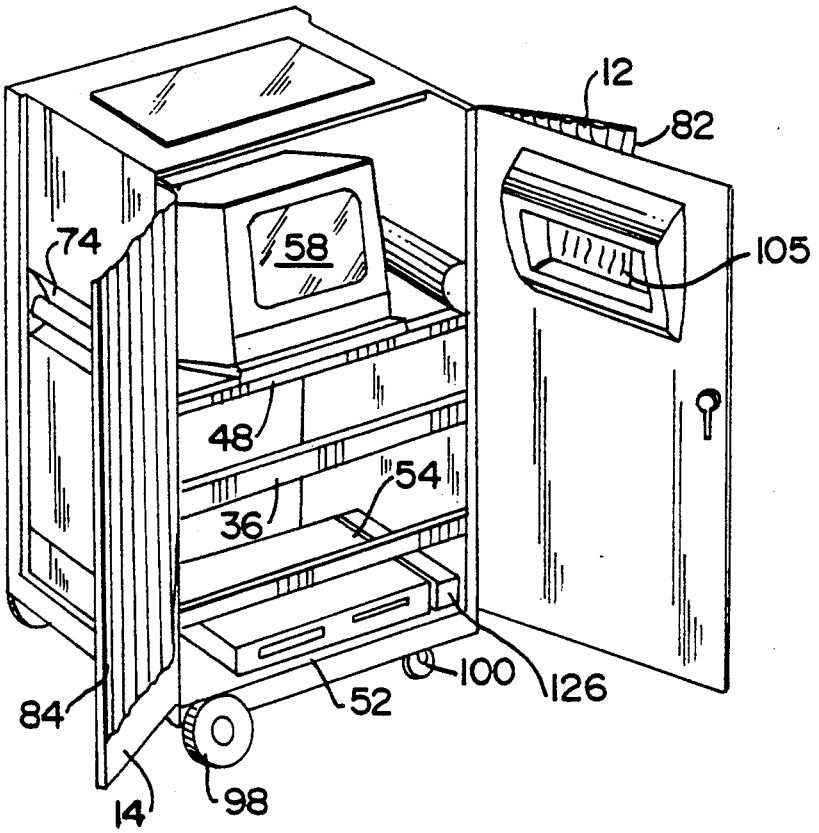
FIG. 6 is an isometric view of the present invention revealing the electronic components of the present invention mounted on the heavy duty structural frame of the voting booth of the invention.
Figure 8:
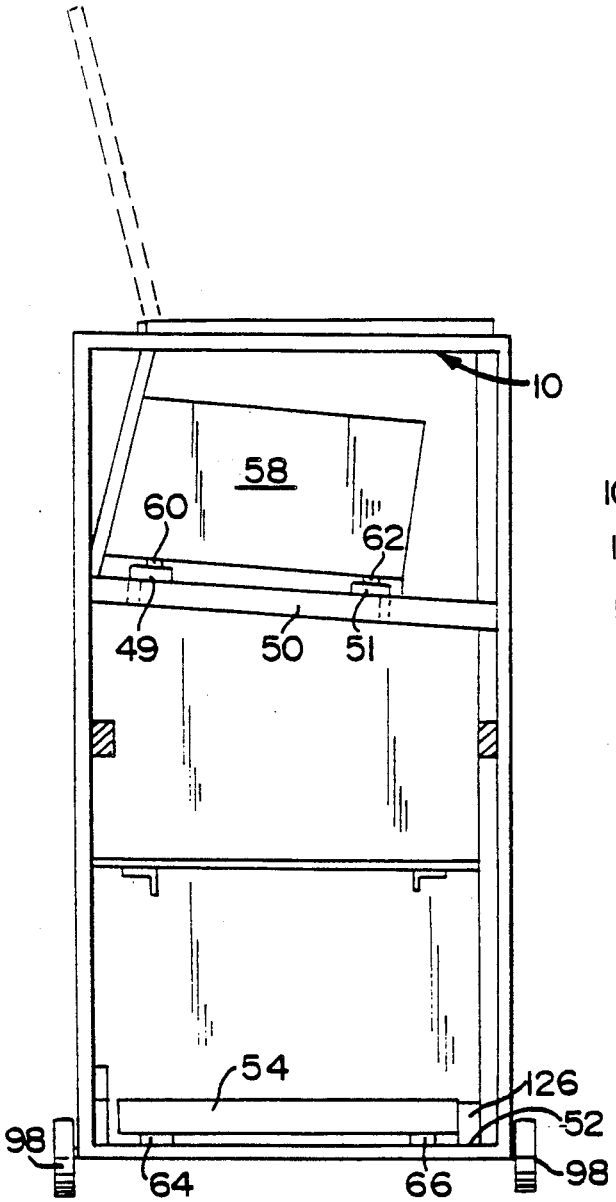
FIG. 8 is a sectional elevational view of the voting booth taken through line 8—8 of FIG. 1.

A base plate 52, best seen in FIGS. 6–8 mounts the computer (CPU) 54 for the electronics. An intermediate bar 56 as seen in FIG. 7 extends between horizontal members 44 and 50. The bar 56 and intermediate horizontal channel member 48, serve to mount the electronic voting module 58.

Figure 5:
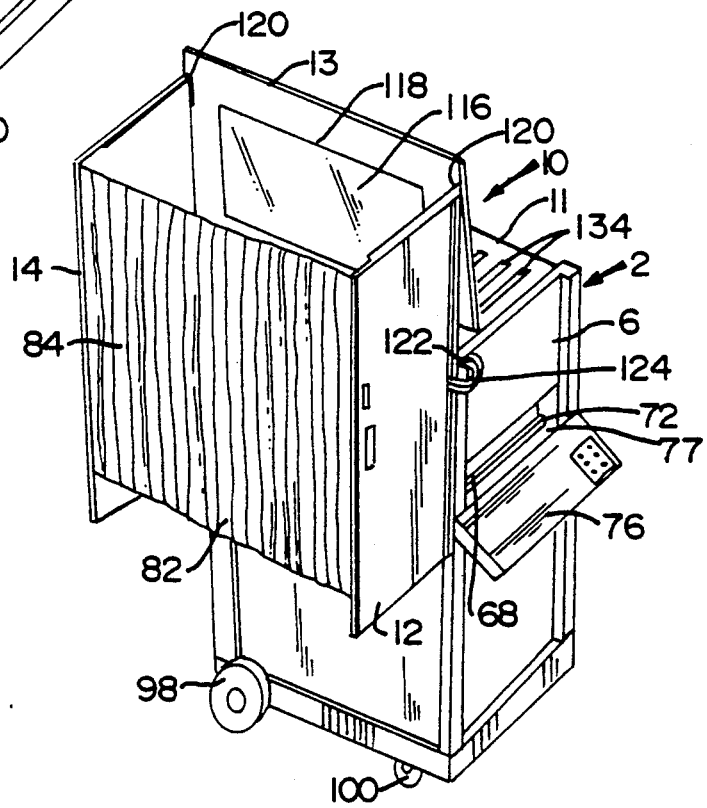
FIG. 5 is the same isometric view of the voting booth of FIG. 1 depicting the voting booth in the fully open mode for voting.

The frame 4 has the lightweight panels attached. Each side panel 6 and 8 is formed of a single piece with a concave recess 68 and 70 respectively. Handles 72 and 74 are secured in the recess 68 and 70 respectively to provide a gripping surface for moving the voting booth 2 and also to provide attachment means to mount the voting register mechanism 76 as shown in FIG. 5. The voting register mechanism 76 is preferably keyboard operated and is provided with a mounting extension 77 configured with an arc cross-section to nest between the surface of the recess 68 and the handle 72.

Figure 4:
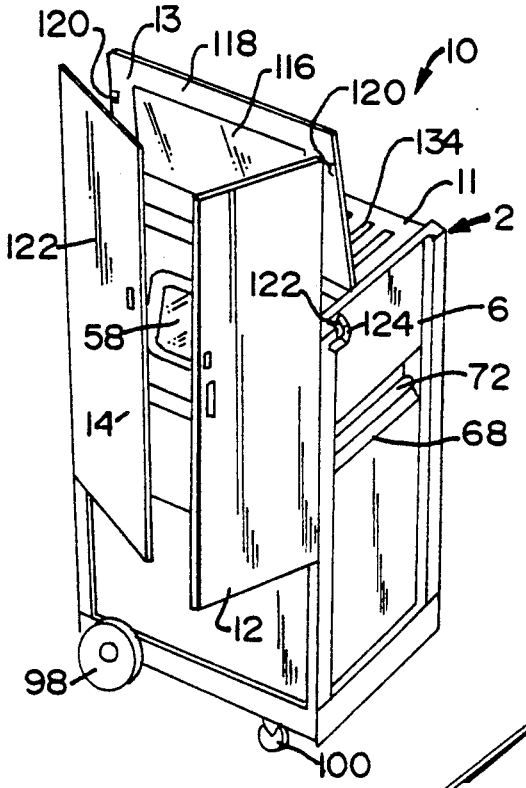
FIG. 4 is the same isometric view of the voting booth seen in FIGS. 1 and 3 at an intermediate open position.
Figure 11:
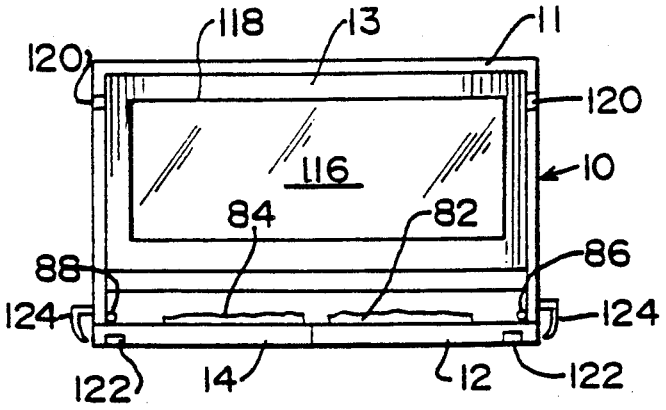
FIG. 11 is a top plan view of the voting booth in the closed mode.
Figure 12:
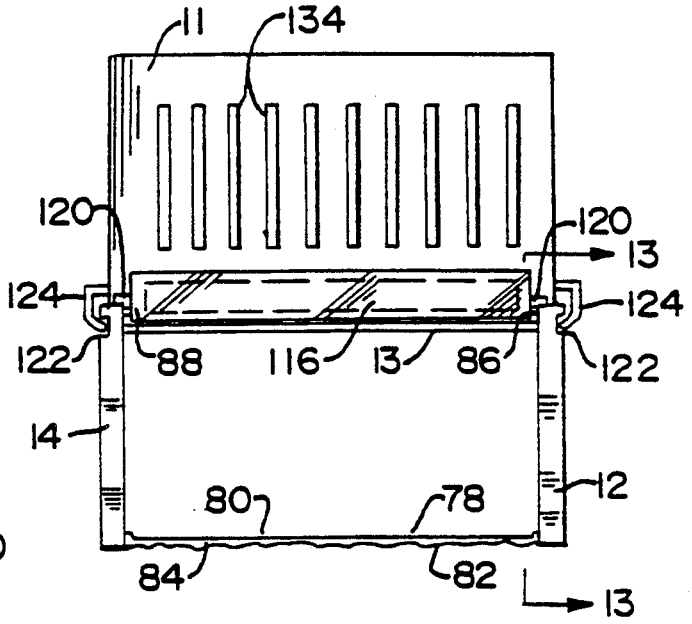
FIG. 12 is a top plan view of the voting booth in the open mode.

The front doors 12 and 14, as seen in FIGS. 4, 11 and 12 are each provided with a pivotally mounted rod 78 and 80 respectively on which curtains 82 and 84 are secured. In the closed or storage mode of the voting booth, the rods 78 and 80 are rotated into abutting relationship against the inside surface of the doors 12 and 14. In the open or operational mode, the rods 78 and 80 are pivoted outwardly ninety degrees from the inside surface of the doors 12 and 14 to form a closure required for voting in privacy.

Figure 14:
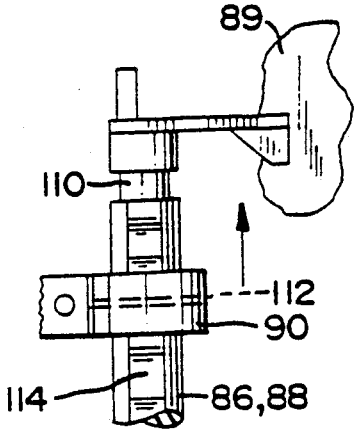
FIG. 14 is a sectional plan view through line 14—14 of FIG. 13.
Figure 13:
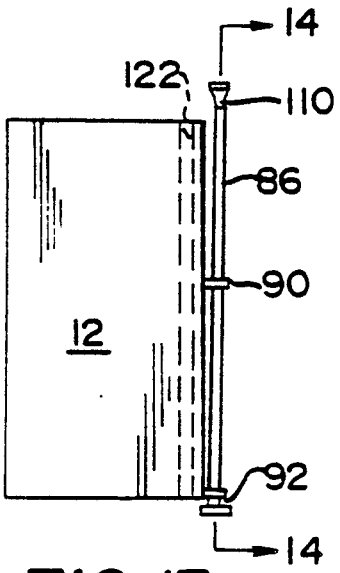
FIG. 13 is a sectional elevational view through line 13—13 of FIG. 12.

The front doors 12 and 14 are mounted respectively on rails 86 and 88 by collars 90 and 92 arranged to slide on the rails 86 and 88. A circular recess 110 is located at the top of each rail 86 and 88 to releasably secure the doors 12 and 14 in the elevated operational position. As seen in FIGS. 13 and 14, the collars 90 and 92 each have a transverse bar 112. The rails 86 and 88 are secured to the front of the voting booth 2 by fixed mounts 89 and have a flat surface 114 on which the bar 112 bears during vertical travel. When the doors 12 and 14 have been elevated to the proper height for the operational mode, the bars 112 are in registry with the recess 110. Thus, rotation of the doors 12 and 14 around the rails 86 and 88 places the bars 112 in the recesses 110 to lock the doors 12 and 14 in the elevated position.

The front doors 12 and 14 are also provided with vertical recesses 122 seen in FIGS. 11–13. The recesses 122 receive extensions 124 formed in the sides of the voting booth 2. The fixed extensions 124 snap into the recesses 122 when the doors 12 and 14 are rotated into the fully open position to maintain the doors 12 and 14 in place during the operational mode of the voting machine 2.

The top 10 is comprised of a vented fixed surface 11 and ballot display 13 that is hingedly mounted to the vented fixed surface 11 for elevation to an operational position to provide a vision barrier that further facilitates privacy for individual voting. FIGS. 11 and 12 illustrate the hinge mechanism 96 attaching the ballot display 13 to the fixed surface 11. The ballot display 13 comprises a glass or transparent plastic plate 116 secured at three of the four edges to the ballot display 13. The unsecured edge 118 enables insertion of a flat printed ballot for viewing by the voter. In the operational mode, the ballot display 13 tilts downwardly at an angle of 10°–15° to vertical to facilitate viewing by the voter. Stops 120 extending from the ballot display 13 bear against the elevated doors 12 and 14 to maintain the ballot display 13 in the desired position.

As seen best in FIG. 12, the vented fixed surface 11 is provided with ventilation slots 134 that facilitate circulation of cooling air provided by fans 136 (best seen in FIG. 7). Practice has shown that two Air Rotron fans of 70/83 CFM capacity provide suitable air circulation for ventilation.

The voting booth 2 is provided with two wheels 98 and two or four casters 100 as seen in FIGS. 6 and 7. The wheels 98 are fixedly mounted on one side edge of the voting booth 2 on an axle(either full or stub axle). Two of the casters 100 are fixed to the bottom of the voting machine on the side opposite the wheels 98 and are conventional casters that can be locked to prevent rotation around the caster axis and also unlocked to enable rotation. Two additional casters 100 may be located on the edge that mounts the wheels 98.

Figure 9:
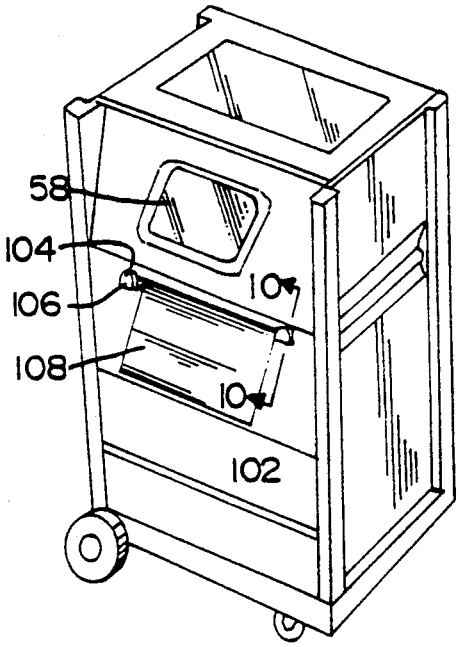
FIG. 9 is an isometric view of the voting booth with the privacy curtains removed to show the display visible to the voter.
Figure 10:
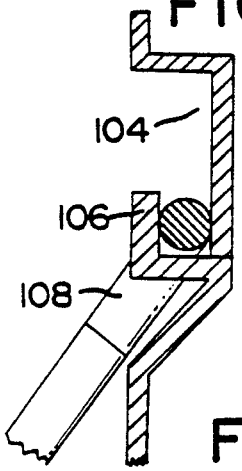
FIG. 10 is a sectional view through line 10—10 of FIG. 9.

The front surface 102 of the voting booth 2 is a light weight panel that conceals the frame 4 and computer (CPU) 54. A recess 104, best seen in FIGS. 9 and 10, is formed in the front surface 102, from which a mounting edge 106 extends. A menu mount 108 can be attached to the edge 106. The front surface 102 also provided with a window 105 in alignment with the electronic voting module 58 to allow the voter to view the ballot display 13.

FIG. 8 depicts the electronic voting module 58 mounted on the horizontal channel member 48 and bar 56 by elastomeric mounts 60 and 62 and the computer (CPU) 54 mounted on the plate 52 by elastomeric mounts 64 and 66. The voting module 58 is a conventional microprocessor controlled electronic mechanism that can be programmed to display all of the various voting options. The voting module 58 is typically no longer than ten inches high by ten inches wide and twelve inches deep(long).

The system electronics connect to the power supply (not shown) through a surge suppressor 126 from which a conventional electrical cable 128 extends, as seen in FIG. 7. During inoperative periods, the cable 128 nests in a repository 130 that can be accessed through an exterior door 132.

In the storage mode the voting booth 2 is closed as shown in FIG. 1 to provide a compact structure that occupies a minimum of space. After delivery from storage to the voting location, the casters 100 are locked to fix the voting machine 2 in place.

In the operational or voting mode, the doors 12 and 14 are rotated around the rails 86 and 88 to an open position and elevated on the rails 86 and 86 to the position wherein the transverse bars 112 can enter the recesses 110 on the rails 86 and 88 to retain the doors 12 and 14 in the elevated position. The curtain rods 78 and 80 are pivoted outwardly to a position wherein the curtains 82 and 84 meet to form a screen. The ballot display 13 is then rotated into the operative position. As seen in FIG. 5, the doors 12, 14, curtains 82, 84 and ballot display 13 provide an area in front of the voting module 58 that conceals the voter during the individual voting procedure. The voting register mechanism 76 is mounted by the arm 77 on the handle 72 located in the concave recess 68 in the side 8.

Voting proceeds by an official inserting a code into the electronic voting register mechanism 76 to arm the electronics for each voter. The voter then separates the curtains 82–84 and views the voting module 58 on which the various choices for voting are displayed and a printed ballot in the ballot display 13.

We claim:

1. A voting booth comprising:

a. a heavy duty structural frame;

b. lightweight panels secured to the heavy duty frame;

c. electronic voting equipment;

d. means to mount the electronic voting equipment on the frame;

e. means to move the voting booth from a storage area to a voting poll area; and f. means for converting the voting booth from a compact storage mode to a functional voting mode wherein the means for converting the voting booth from a compact storage mode to a functional voting mode is comprised of vertical rails on the two front edges of the voting booth; front doors hingedly and slidable mounted on the rails; means at the top of each rail to releasably hold the doors in an elevated position; a curtain hingedly mounted on the inside of each door for rotation into position to form a screen between the doors when the doors are in an open elevated position; a top and a ballot display hingedly mounted to the top.

2. A voting booth as in claim 2 wherein the electronic voting equipment is comprised of a central processing unit; an electronic voting module and a voting register mechanism and the means to mount the electronic voting equipment which is comprised of a base plate; elastomeric mounts secured to the base plate on which the central processing unit is mounted; an intermediately located horizontal structural member extending across the front of the frame; a horizontally extending intermediate bar located at an elevation below and behind the intermediately located horizontal structural member; elastomeric mounts on the intermediately located structural member and the bar which support the electronic voting module; concave recesses formed in each side panel at an intermediate elevation; handles extending transversely in the concave recesses and an arcuate extension from the voting register mechanism which arcuate extension fits within a concave recess behind the transversely extending handle and bears against the transversely extending handle to mount the voting register mechanism on the exterior of the voting booth.

3. A voting booth as in claim 2 further comprising a front surface behind the front doors; a recess in the front surface; a mounting edge in the recess in the front surface; a menu mount and means to attach the menu mount to the mounting edge.

4. A voting booth as in claim 2 further comprising means for ventilating the electronics in the interior of the voting booth.

5. A voting booth as in claim 4 wherein the means ventilating the electronics is a vented fixed surface comprised of ventilation slots in the top and fans located in the interior of the voting booth.

6. A voting booth as in claim 1 wherein the ballot display is hingedly mounted in proximity to the front of the voting booth top and further comprises a transparent plate secured to the ballot display at three edges and means to enable insertion of a printed ballot behind the transparent plate.

7. A voting booth as in claim 6 wherein the hinge mounting the ballot display is set back from the front of the top a distance to provide a pitch angle of 10°-15° to vertical when the ballot display is rotated around the hinge into the operative voting position and further comprising means for retaining the ballot display at an angle of 10°-15° to vertical.

8. A voting booth as in claim 7 wherein the means for maintaining the ballot display at an angle of 10°-15° to vertical are stops extending from the ballot display in alignment with the vertical rails that mount the front doors.

9. A voting booth as in claim 2 further comprising a surge suppressor mounted in the interior of the voting booth, means for connection of the electronics to the surge supressor; an electrical cable extending from the surge supressor for connection to an electrical power source and means to nestingly store the electrical cable during non-use.

10. A voting booth as in claim 1 further comprising vertical edge extensions at the two front edges of the voting booth and a vertical recess in each front door located a distance from the respective door hinge to provide snap entry of the vertical edge extensions into the vertical recesses when the doors are fully opened to the operative position.

11. A voting booth as in claim 1 wherein the means to releasably hold the front doors in the elevated position is comprised of a circular recess at the top of each rail mounting a front door; collars fixed to the respective front doors and slidably mounted on the rails; a flat surface on each rail and a horizontally extending bar in each collar arranged to bear on the flat surface of the rail during elevation and retraction of a front door and to enter the circular recess at the top of the rail when the door is rotated at the elevation of the operational position.

12. A voting booth as in claim 3 further comprising a window in the front surface in alignment with the electronic voting module.

13. A voting booth comprising:

a. a heavy duty structural frame;

b. lightweight panels secured to the heavy duty frame;

c. electronic voting equipment;

d. means to mount the electronic voting equipment on the frame; and e. means to move the voting booth from a storage area to a voting poll area wherein the means to move the voting booth from a storage area to a voting poll area are comprised of a handle on one side of the voting booth, said handle being fixedly mounted in a recessed portion on said side of the voting booth; a wheel on the front and a wheel on the rear of the voting booth on the respective edges of the side of the voting booth opposite the handle, said wheels fixedly aligned transversely to the front of the voting booth and casters on the bottom of the voting booth opposite the wheels.

14. A voting booth as in claim 13 further comprising means to selectively enable the casters to roll and to lock.

15. A voting booth as in claim 14 further comprising a handle on the side on which the wheels are mounted, said handle at an elevation above the elevational midpoint of said side and wherein the handle on the opposite side is at an elevation above the elevational midpoint of the side on which said handle is mounted.

16. A voting booth comprising:

a. a heavy duty structural frame;

b. lightweight panels secured to the heavy duty frame;

c. electronic voting equipment;

d. means to mount the electronic voting equipment on the frame; and e. means to move the voting booth from a storage area to a voting poll area wherein the frame is comprised of four vertically arranged corner channel members; four horizontally disposed base channel members secured to the four vertical corner channel members; and intermediate horizontal channel members extending between adjacent vertical corner channel members.

* * * * *